US007651575B2

(12) United States Patent
Sawford et al.

(10) Patent No.: US 7,651,575 B2
(45) Date of Patent: Jan. 26, 2010

(54) WEAR RESISTANT HIGH TEMPERATURE ALLOY

(75) Inventors: Maria K. Sawford, Corapolis, PA (US); Shubhayu Sinharoy, Philadelphia, PA (US); Sundaram L. Narasimhan, Marshall, MI (US); Alojz Kajinic, Carnegie, PA (US); Andrzej L. Wojcieszynski, Pittsburgh, PA (US); Jeryl K. Wright, Camillus, NY (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/769,065

(22) Filed: Jun. 27, 2007

(65) Prior Publication Data

US 2008/0008617 A1 Jan. 10, 2008

Related U.S. Application Data

(60) Provisional application No. 60/806,743, filed on Jul. 7, 2006, provisional application No. 60/868,606, filed on Dec. 5, 2006.

(51) Int. Cl.

| | |
|---|---|
| ***C22C 19/07*** | (2006.01) |
| ***C22C 38/44*** | (2006.01) |
| ***C22C 30/00*** | (2006.01) |
| ***C22C 38/08*** | (2006.01) |

(52) U.S. Cl. ..... 148/410; 420/53; 420/54; 420/586.1

(58) Field of Classification Search ..... 420/43–55; 148/327

See application file for complete search history.

(56) References Cited

U.S. PATENT DOCUMENTS

| | | | | | |
|---|---|---|---|---|---|
| 2,432,617 | A | * | 12/1947 | Franks et al. | 420/53 |
| 2,432,618 | A | * | 12/1947 | Franks et al. | 420/38 |
| 2,744,821 | A | * | 5/1956 | Osman | 420/53 |
| 2,750,283 | A | * | 6/1956 | Loveless | 420/36 |
| 3,826,689 | A | * | 7/1974 | Ohta et al. | 148/540 |
| 3,865,581 | A | * | 2/1975 | Sekino et al. | 420/40 |
| 4,929,419 | A | | 5/1990 | Wegman et al. | |
| 5,019,332 | A | | 5/1991 | Wegman et al. | |
| 5,019,338 | A | | 5/1991 | Oishi et al. | |
| 5,370,838 | A | | 12/1994 | Sato et al. | |
| 5,495,837 | A | | 3/1996 | Mitsuhashi et al. | |
| 5,567,383 | A | | 10/1996 | Noda et al. | |

(Continued)

FOREIGN PATENT DOCUMENTS

CH 4920792 6/1970

(Continued)

OTHER PUBLICATIONS

International Search Report for corresponding International Application No. PCT/IB2007/001860 mailed Dec. 19, 2007.

(Continued)

*Primary Examiner*—Roy King
*Assistant Examiner*—Jie Yang
(74) *Attorney, Agent, or Firm*—Renner, Otto, Boisselle & Sklar, LLP

(57) ABSTRACT

An Fe—Ni-based alloy that has improved wear resistance at high temperature over Ni-based superalloys is provided. The alloy is particularly useful for manufacturing engine exhaust valves and other high temperature engine components subjected to corrosion, wear and oxidation.

15 Claims, 3 Drawing Sheets

U.S. PATENT DOCUMENTS

| | | | | |
|---|---|---|---|---|
| 5,660,938 | A | 8/1997 | Sato et al. | |
| 5,674,449 | A | 10/1997 | Liang et al. | |
| 5,779,972 | A | 7/1998 | Noda et al. | |
| 5,945,067 | A | 8/1999 | Hibner et al. | |
| 5,951,789 | A | 9/1999 | Ueta et al. | |
| 6,039,919 | A | 3/2000 | Nagashima et al. | |
| 6,099,668 | A | 8/2000 | Ueta et al. | |
| 6,372,181 | B1 * | 4/2002 | Fahrmann et al. | 420/584.1 |
| 6,383,448 | B1 | 5/2002 | Das | |
| 6,436,338 | B1 | 8/2002 | Qiao | |
| 6,458,318 | B1 | 10/2002 | Nishiyama et al. | |
| 6,461,452 | B1 | 10/2002 | Kosa | |
| 6,485,678 | B1 | 11/2002 | Liang et al. | |
| 6,576,186 | B1 | 6/2003 | Martin et al. | |
| 6,685,881 | B2 | 2/2004 | Hamano et al. | |
| 6,702,905 | B1 | 3/2004 | Qiao et al. | |
| 6,866,816 | B2 | 3/2005 | Liang et al. | |
| 6,881,280 | B2 | 4/2005 | Qiao | |
| 6,916,444 | B1 | 7/2005 | Liang | |
| 6,918,972 | B2 | 7/2005 | Ueta et al. | |
| 2004/0184946 | A1 | 9/2004 | Tominaga et al. | |
| 2006/0157171 | A1 | 7/2006 | Ueta et al. | |
| 2006/0283526 | A1 | 12/2006 | Liang | |

FOREIGN PATENT DOCUMENTS

| | | | |
|---|---|---|---|
| EP | 0 183 536 | A2 | 6/1986 |
| EP | 1 464 718 | | 6/2004 |
| JP | 55-148741 | | 5/1979 |
| JP | 56-20148 | | 2/1981 |
| JP | 58-189359 | | 11/1983 |
| JP | 60-46343 | | 3/1985 |
| JP | 62-214149 | | 9/1987 |
| JP | 62214149 | A2 * | 9/1987 |
| JP | 06-344183 | | 12/1994 |
| JP | 10-226837 | | 8/1998 |
| JP | 11-107720 | | 4/1999 |
| JP | 11107720 | A * | 4/1999 |
| JP | 11-199987 | | 7/1999 |
| JP | 11-229059 | | 8/1999 |
| JP | 2001-172751 | | 6/2001 |

OTHER PUBLICATIONS

Written Opinion of the International Search Authority for corresponding International Application No. PCT/IB2007/001860 mailed Dec. 19, 2007.

* cited by examiner

WEAR RESISTANT HIGH TEMPERATURE ALLOY

This application claims the benefit of U.S. Provisional Application Nos. 60/806,743 filed Jul. 7, 2006 and 60/868,606 filed Dec. 5, 2006, the contents of which are hereby incorporated by reference in their entirety.

TECHNICAL FIELD

The present invention relates to a Fe—Ni-based alloy that has improved wear resistance at high temperature over Ni-based superalloys. The alloy is particularly useful for manufacturing engine exhaust valves and other high temperature engine components.

BACKGROUND

High temperature strength, abrasion resistance and corrosion/oxidation resistance are required for materials of exhaust valves, which are generally subjected to temperatures exceeding 800° C. The exhaust valves used in most reciprocating engines can generally be divided into three sections; the head, stem and stem tip. The head and a portion of the head leading from the stem consist of a high temperature, high strength and corrosion resistant alloy such as an austenitic stainless steel or a superalloy. The sealing surface of the valve often includes a weld overlay material, such as a cobalt based, high temperature alloy. The remainder of the stem often is made of a hardenable martensitic steel welded to the high-temperature heat-resistant alloy of the valve head end.

As improved internal combustion engines are developed, addressing the increasing temperatures resulting from higher fuel economy, reduced emissions and yet higher output through newly designed engines has prompted the need for new cost effective materials. In addition, because the demand for and cost of nickel is on the rise, alternatives for high nickel content alloys are desired.

Austenitic stainless steels such as 21-2N, 21-4N-Nb-W and 23-8N have been used for the manufacture of engine valves for many decades. However, due to mechanical property limitations, these alloys are not suitable at operating temperatures above 1472° F. (800° C.) for current durability expectations.

Superalloys, including Fe—Ni-based and Ni-based alloys, have been used for exhaust valve applications typically when the less expensive iron-based stainless valve steel would not provide sufficient high-temperature strength or corrosion resistance, or both, for a given application. Some of the higher nickel alloys used for valve applications include Alloy 751, Alloy 80A, Pyromet 31 and Ni30, for example. Alloys 751, 80A and Pyromet 31 contain high amounts of Ni and are therefore expensive. Valves manufactured from these higher content Ni alloys are susceptible to abrasive and adhesive wear on the seat face due to the lack of wear resistance. Therefore, valves manufactured from some of the higher Ni alloys must be hard faced with a Co-based alloy on the seat face to improve wear resistance. This adds a manufacturing step that further increases the cost of the valve. Thus, there is a need for an intermediate strength valve alloy with properties and cost between that of the austenitic valve steels and the Ni-based superalloys such that the alloy has sufficient wear resistance without requiring a hard facing step.

SUMMARY

In one aspect of the invention, there is provided a wear resistant alloy consisting essentially of, by weight, 0.15% up to 0.35% C; up to 1% Si; up to 1% Mn; greater than 25% to less than 40% Ni; 15% to 25% Cr; up to 0.5% Mo; up to 0.5% W; greater than 1.6% to 3% Al; 1% to 3.5% Ti; greater than 1.1 to 3% total of Nb and Ta; up to 0.015% B; and the balance being Fe and inevitable impurities; wherein $Mo+0.5\,W \leqq 0.75\%$; $Ti+Nb \geqq 4.5\%$ and $13 \leqq (Ti+Nb)/C \leqq 50$, also on a weight percentage basis.

In another aspect of the invention, there is provided an engine valve for a motor vehicle that comprises an alloy consisting essentially of, by weight, 0.15% up to 0.35% C; up to 1% Si; up to 1% Mn; greater than 25% to less than 40% Ni; 15% to 25% Cr; up to 0.5% Mo; up to 0.5% W; greater than 1.6% to 3% Al; 1% to 3.5% Ti; greater than 1.1 to 3% total of Nb and Ta; up to 0.015% B; and the balance being Fe and inevitable impurities; wherein $Mo+0.5\,W \leqq 0.75\%$; $Ti+Nb \geqq 4.5\%$ and $13 \leqq (Ti+Nb)/C \leqq 50$, on a weight percentage basis.

DETAILED DESCRIPTION

Figure 1A:
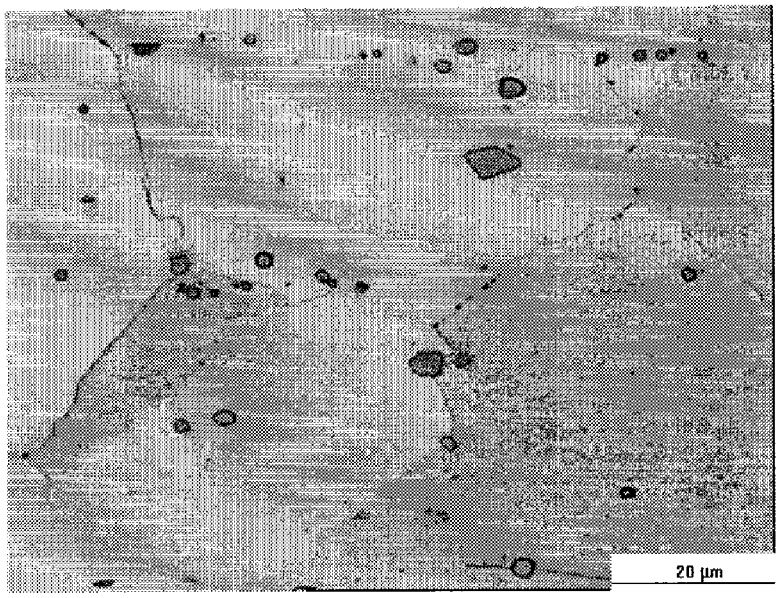
FIG. 1A and FIG. 1B are optical photomicrographs of the alloy of Example 4 of the present invention and a comparative alloy, respectively.

The present invention relates to an iron-nickel-based alloy. The hot hardness, high temperature strength, fatigue strength and wear resistance of the alloy make it useful in a variety of high temperature applications. The alloy is particularly useful in internal combustion engines as cylinder head intake valves, exhaust valves and exhaust gas recirculation valves. Other applications of the alloy include turbine applications, fasteners, afterburner parts, combustion chamber parts, shields for exhaust system oxygen sensors and other parts exposed to elevated temperature and exhaust gas and condensate environments.

Iron-based alloys achieve high temperature mechanical properties through precipitation hardening and solid solution strengthening. The desired properties of iron-based alloys are developed by heat treatment sequences usually involving solution treatment to dissolve strengthening constituents, followed by aging heat treatments to precipitate phases in morphologies and distributions that will produce the desired mechanical properties.

In the invention alloys, the precipitation of a finely dispersed, stable and ordered intermetallic phase, $(Fe,Ni)_3(Al,Ti,Nb)$, commonly referred to as gamma prime ($\gamma'$), contributes to the high temperature strength of the alloy. In addition, the alloy contains primary carbides and carbonitrides for enhanced wear resistance.

The alloy, in one embodiment, comprises in weight percent, 0.15% up to 0.35% C; up to 1% Si; up to 1% Mn; greater than 25% to less than 40% Ni; 15% to 25% Cr; up to 0.5% Mo; up to 0.5% W; greater than 1.6% to 3% Al; 1% to 3.5% Ti; greater than 1.1 to 3% total of Nb and Ta; up to 0.015% B; and the balance being Fe and inevitable impurities.

Carbon may be present in the alloy in an amount ranging from 0.15% to about 0.35% by weight. In one embodiment, carbon is present in an amount of greater than 0.15% to about 0.3%, or from about 0.16% to about 0.3% by weight. Improved wear resistance properties are attributed, at least in part, to the microstructure and hardness of the alloy. Carbon is added to the alloy to promote the formation of niobium-titanium rich primary carbides during ingot solidification. In one embodiment of the invention, the total primary carbide volume fraction of the alloy is greater than 1% and up to 4%. These primary carbides positively influence the adhesive and abrasion wear resistance of the alloy, particularly at elevated temperatures.

Chromium may be present in the alloy in an amount of 15 to about 25 weight percent. In one embodiment, chromium is present in an amount between about 15 to about 20 weight percent. Chromium provides a desirable combination of corrosion resistance such as resistance to acid attack, wear resistance and oxidation resistance. The chromium in the alloy is believed to form a tenacious chromium oxide scale on the surface of the alloy that inhibits progressive high temperature oxidation formation and minimizes oxidation, corrosion and wear rates.

Nickel is added to stabilize the austenitic matrix and to promote the formation of the γ' phase, which improves the high temperature strength of the alloy. Nickel can also advantageously increase resistance to attack from acids formed from exhaust condensates, resistance to oxidation and lead (Pb) corrosion and can also increase the hardness. However, nickel can increase low temperature wear rates and add to the cost of the alloy. Thus, the nickel content is within the range of greater than 25% to less than 40% by weight. In one embodiment, the Ni content is greater than 25% to about 35% by weight, or about 29% to about 35% by weight, or about 30% to about 35%. Higher levels of nickel have also been shown to cause significant sulfidation attack due to the high affinity of nickel to sulfur based constituents present in the engine oil or certain fuels.

Aluminum may be present in the alloy in an amount greater than 1.6% by weight and up to 3% by weight. Aluminum enhances the high temperature strength of the alloy by combining with Ni to precipitate the γ' phase. When the aluminum content is lower than 1.6%, the γ' phase becomes unstable and can transform to the $\eta[(Fe,Ni)_3(Ti, Al)]$ phase which degrades the mechanical properties of the alloy. In one embodiment, the Al content is between 1.63% to about 2.3% by weight.

The titanium content of the alloy is about 1% to about 3.5% by weight. In one embodiment, the Ti content is about 2.0% to about 3.5% by weight. The high temperature strength of the alloy of the invention is enhanced by the precipitation of the γ' phase, which includes titanium, aluminum, iron and nickel. If the titanium content is too high, the workability of the alloy may decrease and the high temperature strength and toughness deteriorate because the deleterious η phase is liable to precipitate. In addition, the titanium combines with carbon and niobium to precipitate the primary carbides that are necessary for wear resistance.

Niobium may be present in the alloy in an amount greater than 1.1% up to about 3.0% by weight. In one embodiment, Nb is present in an amount ranging from about 1.8% to about 2.5% by weight. Niobium partitions to both the γ' phase and the primary carbides. The primary carbides impart wear resistance to the alloy. Due to the chemical similarity between Nb and Ta, Ta can replace some of the Nb. However, the cost of Ta is high, so that a large amount of Ta may be prohibitive. The amount of Nb and Ta together may be 1.1% to about 3.0% by weight, or about 1.8% to about 2.5% by weight.

To achieve a high level of wear resistance, the alloy should contain a minimum amount of the carbide forming elements Ti and Nb. In one embodiment, the elements of the alloy satisfy the equation: $Ti+Nb \geqq 4.5$, based on weight percent of the elements in the alloy. In addition, the amount of carbide forming elements must be balanced with the carbon content to achieve the desired wear resistance through the precipitation of primary carbides. The ratio of carbide forming elements to carbon content, in one embodiment, is generally in the range of $13 \leqq (Ti+Nb)/C \leqq 50$, based on the weight percent of the elements in the alloy. In one embodiment, the ratio is within the range $15 \leqq (Ti+Nb)/C \leqq 35$, or within the range $17 \leqq (Ti+Nb)/C \leqq 30$.

Small amounts of boron can improve the strength of the alloy and can improve grain refinement. The distribution of boron can be both intragranular (within a grain) and intergranular (along grain boundaries). Excessive boron, however, can segregate to grain boundaries and degrade the toughness of the alloy. The boron content in the alloy may be up to about 0.015% by weight. In one embodiment, the boron content is between from about 0.010% to 0.015% by weight.

Molybdenum may be present in the alloy in an amount up to about 0.5% by weight. In one embodiment, the amount of Mo is from about 0.05% to about 0.5% by weight. In one embodiment, molybdenum is not intentionally added to the alloy, but may be present as an inevitable impurity. Molybdenum may be added in an amount effective to promote solid solution hardening of the alloy and provide resistance to creep of the alloy when exposed to elevated temperatures. Molybdenum can also combine with carbon to form primary carbides.

Tungsten may be present in the alloy in an amount up to about 0.5% by weight. In one embodiment, the amount of W is from between about 0.05 to about 0.25% by weight. In one embodiment, tungsten is not intentionally added to the alloy, but may be present as an inevitable impurity. Like molybdenum, tungsten may be added to the alloy to promote solid solution hardening of the alloy and provide resistance to creep of the alloy when exposed to elevated temperatures. In one embodiment, the amount (by weight percent) of molybdenum and tungsten in the alloy satisfies the equation: $Mo+0.5\,W \leqq 0.75\%$.

In the alloys, silicon may be present in an amount up to about 1.0 weight percent. Manganese may be present in an amount up to about 1.0 weight percent. Silicon and manganese can form a solid solution with iron and increase the strength of the alloy through solid solution strengthening as well as increase the resistance to oxidation. When the alloy is formed into parts by casting, the addition of silicon and manganese can contribute to de-oxidation and/or degassing of the alloy. Silicon can also improve the castability of the material. In the case where the part is not cast, silicon and manganese can be reduced or omitted from the alloy.

The balance of the alloy is preferably iron (Fe) and incidental impurities. The alloy can contain trace amounts of sulphur, nitrogen, phosphorous and oxygen. Other alloy additions that do not adversely affect corrosion, wear and/or hardness properties of the alloy may be added to the alloy.

In one embodiment, the alloy does not contain any intentionally added vanadium. The presence of significant amounts of vanadium may adversely affect the desirable properties of the alloy due to the formation of the low melting temperature oxide, $V_2O_5$.

In one embodiment, the alloy does not contain any intentionally added copper, which is generally added when the alloy will be cold worked into the desired geometry.

The alloy of the present invention has good pin abrasion wear resistance. In one embodiment, the alloy has a pin abrasion wear loss of less than 100 mg after solution treating and aging.

The alloy of the present invention can be prepared using conventional practices. The elemental materials may be melted by vacuum induction melting, air induction melting, arc melting/AOD (argon-oxygen decarburization), ESR (electoslag remelting), or combinations thereof. The melted materials are then cast into ingots. Each of the resulting ingots is then subjected to a soaking treatment, and then scarfed, and further subjected to forging and rolling to form a bar.

EXAMPLES

Alloys of the invention shown in Table 1 are produced in the form of 50 lb. (22.7 kg) ingots by vacuum induction melting, and forged into octagonal bars 1 inch in diameter. Mechanical test specimens are cut from the bars and are solution treated at 1650° F. (900° C.) for 30 minutes, air or water cooled, and then aged at 1350° F. (730° C.) for 4 hours and air cooled. Examples 1-8 are embodiments of the present invention and Alloys A-G are comparative alloys. Comparative alloys A, C and D are commercially available superalloys and comparative alloys E-G are commercially available austenitic valve steels. Alloy B is a modification of Alloy A, wherein the amount of carbon is increased to show the effect of carbon on the mechanical properties of Alloy A.

TABLE 1

| Alloy | C | Si | Mn | Cr | Ni | Al | Ti | Nb | Mo | W | Fe | B | other | Ti + Nb | (Ti + Nb)/C |
|---|---|---|---|---|---|---|---|---|---|---|---|---|---|---|---|
| Ex 1 | 0.193 | 0.162 | 0.02 | 15.06 | 30.6 | 1.63 | 2.72 | 2.01 | 0.005* | 0.003* | 47.587 | 0.01 | | 4.73 | 24.5 |
| Ex 2 | 0.2 | | | 15.07 | 30.8 | 1.77 | 2.62 | 2.04 | 0.004* | 0.004* | Bal. | 0.008 | | 4.66 | 23.3 |
| Ex 3 | 0.185 | | 0.03 | 15.46 | 30.7 | 1.71 | 2.67 | 2.12 | 0.004* | | Bal. | 0.01 | | 4.79 | 25.9 |
| Ex 4 | 0.21 | 0.21 | 0.19 | 15 | 30.6 | 1.62 | 2.68 | 1.98 | 0.003* | | Bal. | 0.01 | | 4.66 | 22.2 |
| Ex 5 | 0.23 | 0.15 | 0.19 | 15.01 | 30.9 | 1.62 | 2.71 | 1.92 | 0.004* | | Bal. | 0.008 | | 4.63 | 20.1 |
| Ex 6 | 0.21 | 0.14 | 0.19 | 15.03 | 30.5 | 1.65 | 2.64 | 1.9 | 0.003* | | Bal. | 0.01 | | 4.54 | 21.6 |
| Ex 7 | 0.27 | 0.15 | 0.2 | 17 | 33 | 2.1 | 3.25 | 2 | 0.5 | 0.25 | Bal. | 0.008 | | 5.25 | 19.4 |
| Ex 8 | 0.35 | 0.15 | 0.2 | 19 | 35 | 2.3 | 3.5 | 2.5 | 0.2 | 0.2 | Bal. | 0.008 | | 6.0 | 17.1 |
| Alloy A | 0.04 | | | 14.3 | 31.3 | 1.9 | 2.6 | 0.66 | 0.66 | 0.02 | Bal. | 0.003 | | 3.36 | 81.5 |
| Alloy B | 0.1 | | | 15.9 | 31.4 | 1.8 | 2.5 | 0.76 | 0.51 | 0.26 | Bal. | 0.008 | | 3.26 | 32.6 |
| Alloy C | 0.06 | 0.35 | 0.35 | 20 | Bal. | 1.25 | 2.35 | | | | 0.75 | | 0.05Cu, | 2.35 | 39.2 |
| | | | | | | | | | | | 0.75 | | 1Co | | |
| Alloy D | 0.08 | 0.3 | | 15 | Bal. | 1.2 | 2.5 | 1 | | | 8 | | | 3.5 | 43.8 |
| Alloy E | 0.5 | 0.25 | 9 | 21 | 4 | | | | | | Bal. | | 0.45N | — | — |
| Alloy F | 0.5 | 0.45 | 9 | 21 | 4 | | | 2 | | 1 | Bal. | | 0.5N | — | — |
| Alloy G | 0.35 | 0.75 | 2.5 | 23 | 8 | | | | 0.5 | 0.5 | Bal. | | 0.45N | — | — |

*not intentionally added

Heat Treatment

The alloys of the present invention require solution treating at 1650° F. (899° C.) for 30 minutes and aging at 1350° F. (732° C.) for four hours to produce a hardness of 36/39 HRC. The solution treating temperature is lower than that typically used to solution treat commercially available superalloys including the Alloys A, C and D. These superalloys are typically solution treated at 1950° F. (1066° C.) and above and generally require a two-step aging process to produce adequate hardness. The alloys of the present invention can be aged in a single step at one temperature for adequate hardness response.

Microstructural Evaluation

Figure 1B:
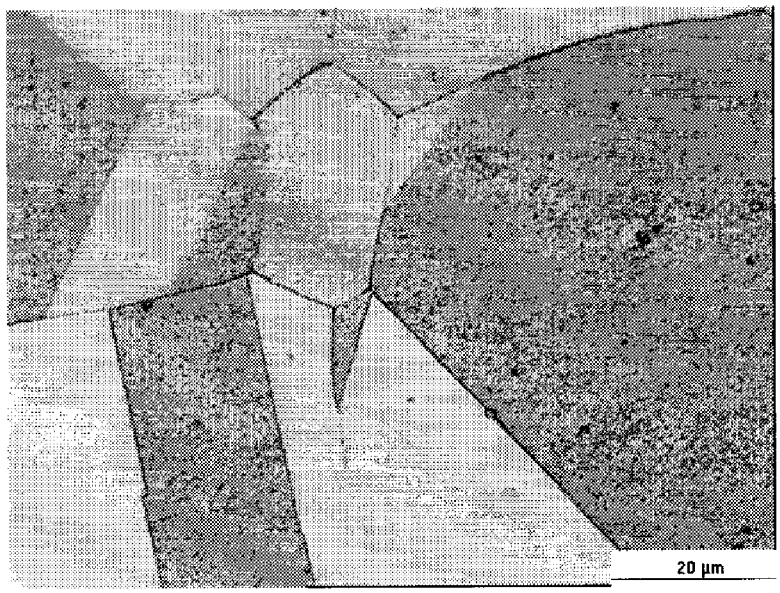

The etched microstructure of the alloy of Example 4 of the present invention that was solution treated at 1650° F. (899° C.) for 30 minutes and aged at 1350° F. (732° C.) for four hours is shown in FIG. 1A. The etched microstructure of comparative Alloy A that was solution treated at 1950° (1066° C.) for 30 minutes and aged at 1380° F. (749° C.) for four hours is shown in FIG. 1B. These microstructures consist of primary carbides in an austenitic matrix. The primary carbides are those that precipitate during ingot solidification.

The primary carbides impart wear resistance to the alloy. As the volume fraction of primary carbides increase, the wear resistance of the alloy increases. The volume fraction of primary carbides in the alloys of Example 4 and comparative Alloy A are also shown in FIG. 1. The carbide volume fraction in the alloy of Example 4 is about 2.1%. The carbide volume fraction of comparative Alloy A is about 0.4%.

Wear Resistance

The abrasive wear resistance of the alloys was evaluated using a pin abrasive wear test according to ASTM G132. This test uses ¼ inch diameter specimens that are heat treated to application hardness. A 15-lb load is applied to the specimen as it rotates at 22 rpm. The specimen traverses 500 inches (12.7 m) in a non-overlapping pattern on a 150 mesh garnet paper. The weight of the specimen before and after the test is used to determine the pin abrasion weight loss. The lower the weight loss, the more resistant the alloy is to abrasive wear. The data is given in Table 2. Example 4 has a weight loss of 93 mg, which is lower than that of the superalloys Alloys A through D. The wear resistance is directly related to the amount of primary carbides (and, thus, the total titanium and niobium content) in an alloy. For example, Example 4 and Alloy A have a total carbide volume fraction of about 2.1% and 0.4%, respectively, and Example 4 has better wear resistance. Increasing carbon content of Alloy A will not result in a sufficient increase in wear resistance, as evidenced by pin abrasion weight loss of Alloys A and B. Additional titanium and niobium is needed to produce an alloy with sufficient wear resistance. The commercial austenitic valve steels Alloys E and F have sufficient wear resistance for automotive exhaust valves so that hardfacing is not necessary. The wear resistance of Example 4 is similar to that of Alloy E, which suggests that exhaust valves manufactured with an alloy similar to that of Example 4 may not need to be hardfaced.

TABLE 2

| Alloy | Heat Treatment | Wt. Loss (mg) |
|---|---|---|
| Ex. 4 | 1650° F./30 min., WQ, 1350° F./4 hrs. | 93 |
| Alloy A | 1920° F./30 min., WQ, 1350° F./4 hrs. | 115 |
| Alloy B | 1650° F./30 min., WQ, 1350° F./4 hrs, | 107 |
| Alloy C | 2050° F./1 hr, AC, 1580° F./4 hrs, AC, 1345° F./4 hrs, AC | 100 |
| Alloy D | 2050° F./1 hr, AC, 1580° F./4 hrs, AC, 1345° F./4 hrs, AC | 99 |
| Alloy E | 2150° F./1 hr., WQ, 1500° F./10 hrs | 94 |
| Alloy F | 2130° F./1 hr., WQ, 1500° F./10 hrs | 80 |

Wear Resistance (Exhaust Valves)

Figure 2:
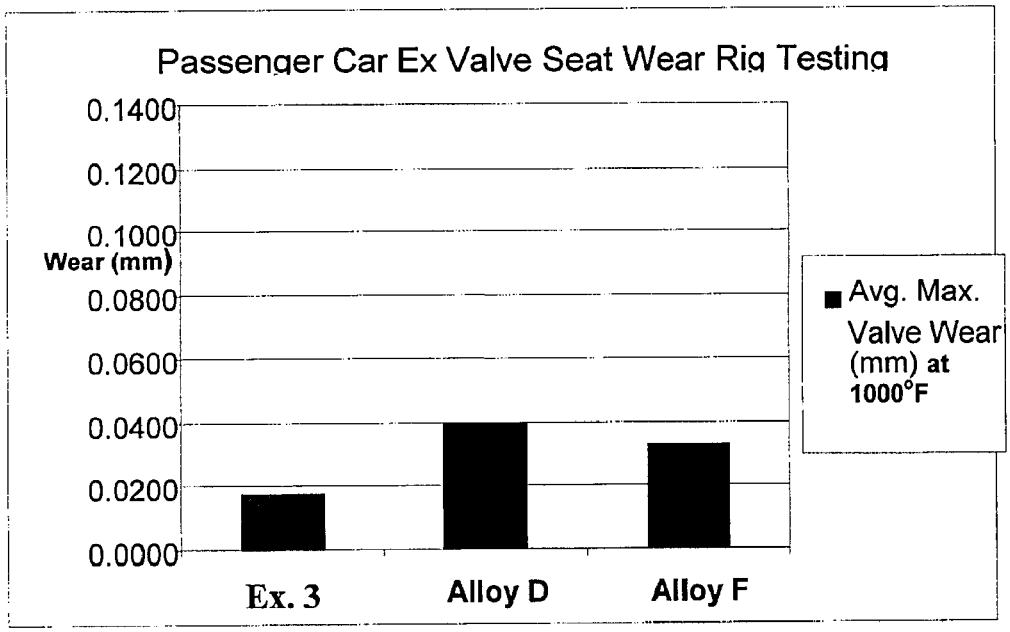
FIG. 2 is a bar graph of the relative wear depths of an embodiment of an exhaust valve the present invention and comparative alloy exhaust valves.

Exhaust valves made from the alloy of Example 3 and the comparative alloys D and F were subjected to an elevated temperature simulation wear test. The exhaust valves were tested at a valve seat face temperature of 1000° F. (540° C.) under a load actuating the valve to simulate the combustion loads of about 500-550 lbs in a spark ignited internal combustion engine. The mean wear depths (mm) were measured for the exhaust valves of Example 3 and those of comparative Alloy D and Alloy F. The results, presented in FIG. 2, show that the mean wear depth of the exhaust valve of the present invention is less than that of each of the comparative exhaust valves. The better wear resistance of the alloy of the present invention is believed to be attributed to the higher hardness and the presence of the primary carbides.

Hot Hardness

Figure 3:
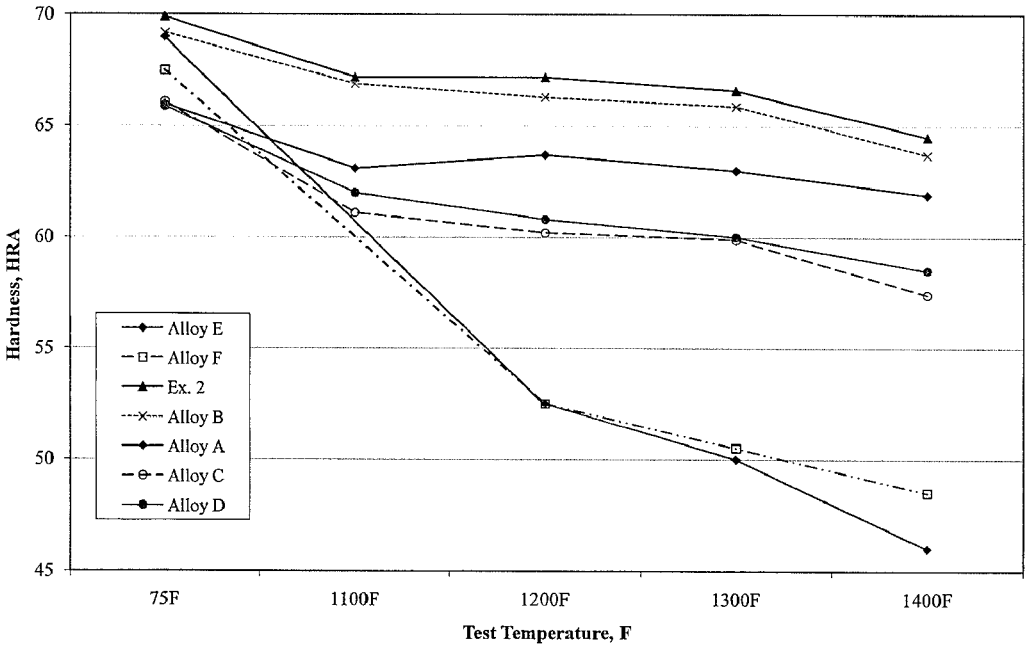
FIG. 3 is a graph of the hot hardness versus temperature for an embodiment of the alloy of the present invention and several comparative alloys.

Hot hardness is the hardness measured at a given elevated temperature. The hot hardness of an alloy also influences the wear resistance of the material. The higher the hot hardness the more wear resistant the alloy. Hot hardness measurements are taken at room temperature and at temperatures between 1100° F. (593° C.) to 1400° F. (760° C.). This test is conducted by placing a furnace around the specimen and indenter and the temperature within the furnace is slowly increased to the test temperature. The specimen is soaked at the temperature for about 30 minutes to ensure uniform heating throughout the specimen prior to testing the hardness. Hardness measurements are taken using the Rockwell A (HRA) scale. The hot hardness of the alloys of invention and the comparative commercially available alloys are shown in FIG. 3. The hot hardness of the alloy of the invention is higher than that of comparative Alloys A, B, C and D, and much higher than the austenitic valve steels Alloys E and F. The significant decrease in hot hardness in the austenitic valve steels is related to microstructural changes. This data further indicates the improved wear resistance of the alloys of invention.

Oxidation Resistance

During engine operation, the exhaust valves can be exposed to temperatures up to 1600° F. (871° C.). Therefore, the exhaust valve must have oxidation resistance. Samples of the alloy of Example 2 and Alloy A were exposed at 1500° F. (816° C.) for 500 hrs. The depth of oxidation for the alloy of Example 2 is 0.0174 mm at 500 hours. The depth of oxidation for Alloy A is 0.0333 mm at 500 hours. This indicates that Example 2 has improved oxidation resistance over Alloy A, a commercially available valve superalloy.

Elevated Temperature Tensile Properties

The elevated temperature tensile properties at 1500° F. (816° C.) of the alloy of Example 2 and of comparative valve alloys are given in Table 3. The yield strength of the alloy of Example 2 is higher than that of Alloys A and B and much higher than the austenitic valve steels, Alloys F and G. Sufficient yield strength is needed to prevent the valve from deforming while operating in an engine. The yield strength of the alloys of the invention as embodied by Example 2 is higher than that of other comparative commercially available Fe-based valve alloys, which indicates the alloys of invention have sufficient strength. The tensile strength of the alloy of Example 2 is higher than that of Alloys B through G, and similar to that of Alloy A, which indicates that the alloys of the invention can be subjected to higher stress levels before catastrophic failure occurs.

TABLE 3

| Alloy | Heat Treatment | as-heat treated Hardness, HRC | Tensile Properties at 816 C. (1500 F.) YS, MPa | UTS, Mpa | % Elong. | % RA |
|---|---|---|---|---|---|---|
| Ex. 2 | 1650 F./30 min, AC, 1350 F./4 hrs | 39 | 356 | 590 | 55 | 77.5 |
| Alloy A | 1950 F. + 1380 F./4 hrs | 31.5 | 256 | 490 | 22 | 25.9 |
| Alloy B | 1650 F./30 min., AC, 1350 F./4 hrs | 37 | 322 | 601 | 32 | 72.5 |
| Alloy C | 1975 F./8 hrs + 1300 F./16 hrs | | | 496 | 21 | 19 |
| Alloy D | 2100 F./4 hrs + 1550 F./24 hrs, 1300 F./20 hrs | | 526 | 554 | 26 | 35.9 |
| Alloy F | 2130 F. + 1500 F. | 32.5 | 114 | 365 | 35 | 54.5 |
| Alloy G | 2150 F. + 1500 F. | | 174 | 318 | 50 | 71.7 |

Creep Rupture Stress

Sufficient creep strength is needed to prevent creep related failure in the fillet area of valves. The creep stress needed to rupture the alloys of invention and several comparative valve alloys in 100 hrs at 1500° F. (816° C.) is given in Table 4. The creep rupture stress of the alloy of Example 2 is comparable to that of Alloys A and B and much better than the austenitic valve steels F and G. The austenitic valve steels have sufficient creep rupture strength for exhaust valve applications to prevent failures due to creep in the fillet area of the valve. Therefore, the alloys of invention should also have sufficient creep strength to prevent failure.

U-Notch Impact Toughness

During engine operation, the valve seat face impacts against the insert. Sufficient toughness is required to prevent cracking of the seat face. The U-notch impact toughness (specification JIS Z2202) of the alloy of Example 2 and several comparative valve alloys after heat treating and after heat treating and a 400 hr exposure at 1472° F. (800° C.) was tested. The results are given in Table 4. After the 400 hr exposure, the alloys of the invention, as exemplified by Example 2, have significantly better impact toughness than Alloy F and is similar to Alloy A. The results show that the toughness of the alloys of the invention is suitable for automotive valve applications.

TABLE 4

| Alloy | Heat Treatment | Creep Rupture Stress (MPa) in 100 hrs at 1500 F. | U-notch Impact Toughness as-heat treated J/cm$^2$ | U-notch Impact Toughness after 800 C./400 hrs J/cm$^2$ | Hardness after 800 C./400 hrs, HRC |
|---|---|---|---|---|---|
| Ex. 2 | 1650 F./30 min, WQ, 1350 F./4 hrs, AC | 158 | 88 | 56 | 33 |
| Alloy A | 1950 F. + 1380 F./4 hrs | 167 | 151 | 100 | 31.5 |
| Alloy B | 1650 F./30 min, WQ, 1350 F./4 hrs, AC | 168 | 108 | 55 | 32 |
| Alloy C | 1975 F./8 hrs + 1300 F./16 hrs | 196 | | 76 | 29.5 |
| Alloy D | 2100 F./4 hrs + 1550 F./24 hrs, 1300 F./20 hrs | 205 | | 114 | 28 |
| Alloy F | 2150 F. + 1500 F. | 120 | 13 | 12 | 32.5 |
| Alloy G | 2150 F. + 1500 F. | 107 | | | |

Fatigue Strength

Figure 4:
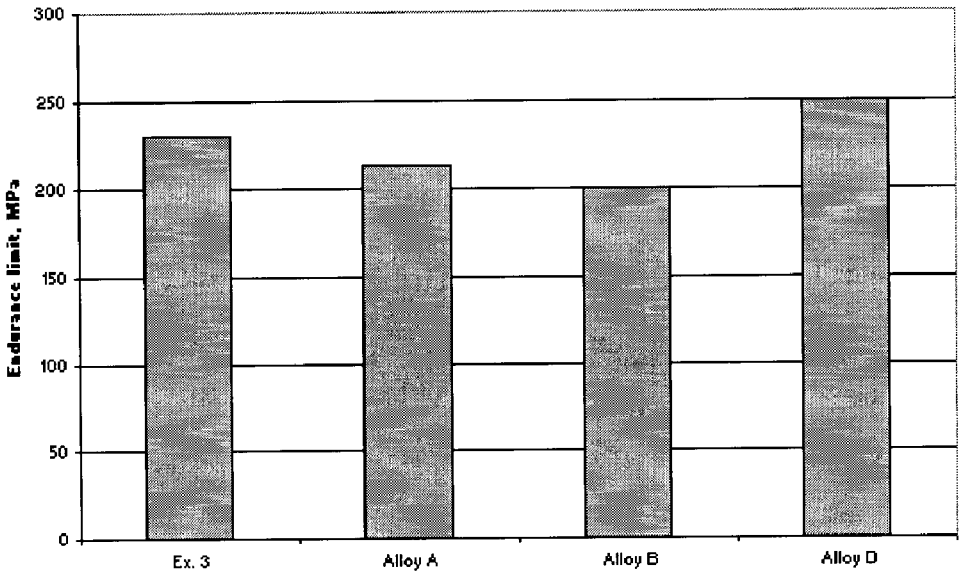
FIG. 4 is a bar graph of the fatigue endurance limit determined using a standard RR Moore type rotating beam test at 816° C. at $10^8$ cycles for an embodiment of the present invention and several comparative alloys.
Figure 5:
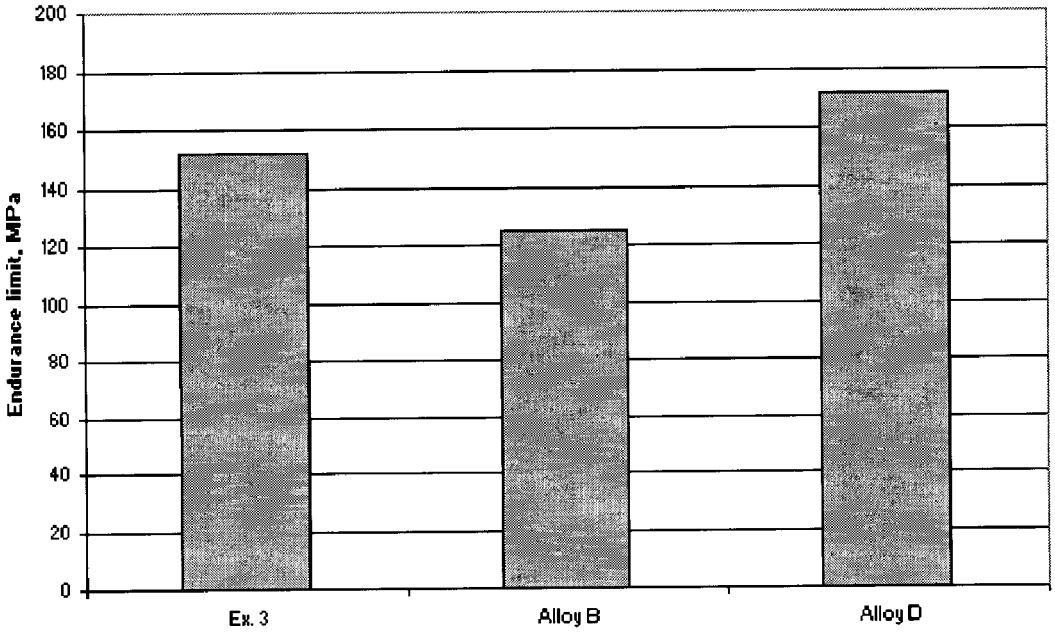
FIG. 5 is a bar graph of the fatigue endurance limit determined using a standard RR Moore type rotating beam test at 871° C. at $10^8$ cycles for an embodiment of the present invention and several comparative alloys.

Fatigue strength is needed to prevent fatigue related failures in the stem fillet area of a valve. Rotating beam fatigue tests were conducted on the alloys of the invention and Alloys A, B and D at 1500° F. (816° C.) at $10^8$ cycles with applied stresses of 25-45 ksi. The results are shown in FIG. 4. The fatigue strength of the alloy of Example 3 of the invention is somewhat better than that of Alloys A and B. Therefore, the alloys of invention, as exemplified by Example 3, have sufficient fatigue strength for automotive valves. The fatigue endurance limit of the alloy of Example 3 and that of comparative alloys B and D at 1600° F. (871° C.) at $10^8$ cycles is shown in FIG. 5. At this temperature, the fatigue strength of the alloy of Example 3 is better that that of comparative Alloy B.

The alloys of the present invention can be used to produce engine valves. In one embodiment, there is provided an engine valve for a motor vehicle comprising an alloy consisting essentially of, by weight, 0.15% up to 0.35% C; up to 1% Si; up to 1% Mn; greater than 25% to less than 40% Ni; 15% to 25% Cr; up to 0.5% Mo; up to 0.5% W; greater than 1.6% to 3% Al; 1% to 3.5% Ti; greater than 1.1 to 3% total of Nb and Ta; up to 0.015% B; and the balance being Fe and inevitable impurities. The engine valve alloy may contain elements that satisfy the following equation: Mo+0.5 W≦0.75%, based on the weight percent of the elements in the alloy. The alloy may contain the carbide containing elements titanium and niobium in amounts that satisfy the following equations: Ti+Nb≧4.5% and 13≦(Ti+Nb)/C≦50, on a weight percentage basis.

Exhaust Valve Wear Resistance

Exhaust valves made from the alloy of Example 3 were subjected to a 100 hour dyno test in a V-8 spark ignited gasoline engine and to a 500 hour dyno test in a heavy duty compression ignited diesel engine. The exhaust valves passed both wear tests, exhibiting acceptable wear resistance in each test.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A wear resistant alloy consisting essentially of, by weight, 0.15% up to 0.35% C; up to 1% Si; up to 1% Mn; greater than 25% to 35% Ni; 15% to 25% Cr; up to 0.5% Mo; up to 0.5% W; greater than 1.6% to 3% Al; 1% to 3.5% Ti; greater than 1.1 to 3% total of Nb and Ta; up to 0.015% B; and the balance being Fe and inevitable impurities; wherein Mo+0.5 W≦0.75%; Ti+Nb≧4.5% and 13≦(Ti+Nb)/C≦50, on a weight percentage basis; wherein the total primary carbide volume fraction is greater than 1% and up to 4% and the primary carbides are randomly precipitated.

2. The alloy of claim 1 wherein the following elements are present in the following amounts, in weight percent: greater than 0.15% to 0.3% C; 1.7% to 2.5% total of Nb and Ta.

3. The alloy of claim 2 wherein the elements W, Mo and V are not present in the alloy in greater than inevitable impurity amounts.

4. The alloy of claim 1 wherein the alloy has good pin abrasion wear resistance as measured by a pin abrasion wear loss of less than 100 mg after solution treating and aging.

5. The alloy of claim 1 wherein the elements of the alloy satisfy the equation: 15≦(Ti+Nb)/C≦35, on a weight percentage basis.

6. The alloy of claim 1 wherein the elements of the alloy satisfy the equation: 17≦(Ti+Nb)/C≦30, on a weight percentage basis.

7. A wear resistant alloy consisting essentially of, by weight, greater than 0.15% up to 0.3 C; up to 1% Si; Up to 1% Mn; 29% to 35% Ni; 15% to 20% Cr; up to 0.25% Mo; up to 0.25% W; 1.63 to 2.3% Al; 2.0% to 3.5% Ti; 1.8% to 2.5% total of Nb and Ta; 0.005% to 0.015% B; and the balance being Fe and inevitable impurities; wherein Ti+Nb≧4.5 and 13≦(Ti+Nb)/C≦50, on a weight percentage basis; wherein the total primary carbide volume fraction is greater than 1% and up to 4% and the primary carbides are randomly precipitated.

8. The alloy of claim 7 wherein the elements W and Mo are not present in the alloy in greater than inevitable impurity amounts.

9. The alloy of claim 7 wherein the elements of the alloy satisfy the equation: 15≦(Ti+Nb)/C≦35, on a weight percentage basis.

10. The alloy of claim 7 wherein the elements of the alloy satisfy the equation: 17≦(Ti+Nb)/C≦30, on a weight percentage basis.

11. An engine valve for a motor vehicle comprising an alloy consisting essentially of, by weight, 0.15% up to 0.35% C; up to 1% Si; up to 1% Mn; greater than 25% to 35% Ni; 15% to 25% Cr; up to 0.5% Mo; up to 0.5% W; greater than 1.6% to 3% Al; 1% to 3.5% Ti; greater than 1.1 to 3% total of Nb and Ta; up to 0.015% B; and the balance being Fe and inevitable impurities; wherein Mo+0.5 W≦0.75%; Ti+Nb≧4.5% and 13≦(Ti+Nb)/C≦50, on a weight percentage basis; wherein the total primary carbide volume fraction is greater than 1% and up to 4% and the primary carbides are randomly precipitated.

12. The engine valve of claim 11 wherein the following elements are present in the alloy in the following amounts, in weight percent: greater than 0.15% to 0.3% C; 1.7% to 2.5% total of Nb and Ta.

13. The engine valve of claim 11 wherein the elements W, Mo and V are not present in the alloy in greater than inevitable impurity amounts.

14. The engine valve of claim 11 wherein the elements of the alloy satisfy the equation: $15 \leqq (Ti+Nb)/C \leqq 35$, on a weight percentage basis.

15. The engine valve of claim 11 wherein the elements of the alloy satisfy the equation: $17 \leqq (Ti+Nb)/C \leqq 30$, on a weight percentage basis.

* * * * *

UNITED STATES PATENT AND TRADEMARK OFFICE

CERTIFICATE OF CORRECTION

PATENT NO. : 7,651,575 B2
APPLICATION NO. : 11/769065
DATED : January 26, 2010
INVENTOR(S) : Maria K. Sawford et al.

It is certified that error appears in the above-identified patent and that said Letters Patent is hereby corrected as shown below:

Title page: item (73) Assignee: "Eaton Corporation, Cleveland, OH (US)" should read -- Eaton Corporation, Cleveland, OH (US) and Crucible Materials Corporation, Syracuse, NY (US) --

Signed and Sealed this
Twelfth Day of June, 2012

David J. Kappos

David J. Kappos
*Director of the United States Patent and Trademark Office*